United States Patent [19]

Jacquet

[11] 4,368,365

[45] Jan. 11, 1983

[54] SWITCHING DEVICE, NOTABLY FOR THE CONTROL OF AN ELECTRICAL MOTOR IN AN AUTOMOTIVE VEHICLE

[75] Inventor: Maurice A. Jacquet, Maurepas, France

[73] Assignee: Valeo, Paris, France

[21] Appl. No.: 197,818

[22] Filed: Oct. 17, 1980

[30] Foreign Application Priority Data

Oct. 18, 1979 [FR] France ..... 79 25949

[51] Int. Cl.[3] ..... H01H 21/78

[52] U.S. Cl. ..... 200/11 TW; 200/11 G; 200/303

[58] Field of Search ..... 200/11 R, 11 G, 11 J, 200/11 K, 11 TW, 61.86, 155 R, 155 A, 292, 303, 316, 336

[56] References Cited

U.S. PATENT DOCUMENTS

| | | | |
|---|---|---|---|
| 3,222,490 | 12/1965 | Huntress et al. | 200/316 |
| 3,523,165 | 8/1970 | Datchenko et al. | 200/11 K |
| 3,621,162 | 11/1971 | Wall | 200/11 G |
| 3,703,613 | 11/1972 | Abel | 200/11 J X |
| 3,983,352 | 9/1976 | Ellis, Jr. et al. | 200/11 J |
| 4,190,749 | 2/1980 | Erickson et al. | 200/11 TW |

FOREIGN PATENT DOCUMENTS

| | | | |
|---|---|---|---|
| 2026242 | 1/1981 | United Kingdom | 200/11 TW |

*Primary Examiner*—J. R. Scott

*Attorney, Agent, or Firm*—Curtis, Morris & Safford

[57] ABSTRACT

A switching device, notably for the control of an electrical motor in an air conditioning or ventilation installation of a vehicle, wherein a rotary knob carrying a slider contact is mounted on a small column of the bottom of a cage, and a circuit plate is mounted on the end of the column and immobilized by snap-in engagement with walls of the cage. The cage is adapted to be fixed in a casing or support provided in an instrument board of the vehicle.

16 Claims, 21 Drawing Figures

Fig. 1
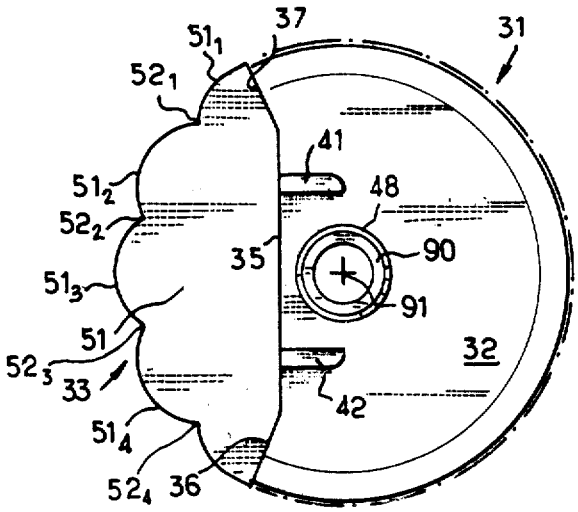
Fig. 2
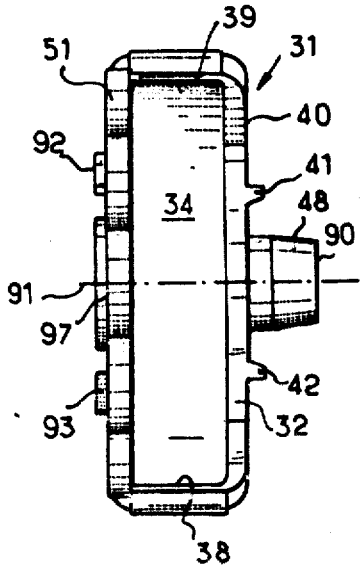
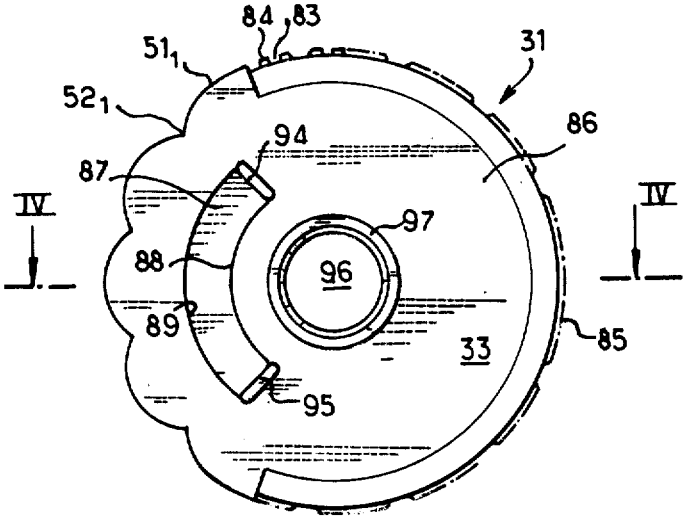
Fig. 3
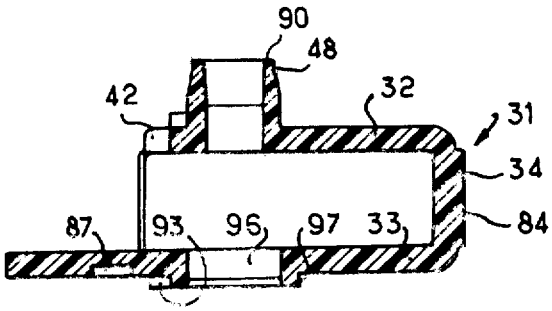
Fig. 4

Fig. 5
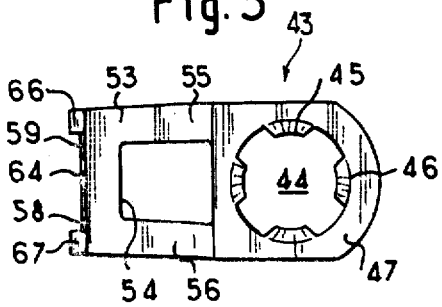
Fig. 6
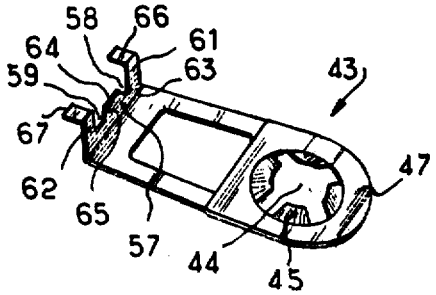
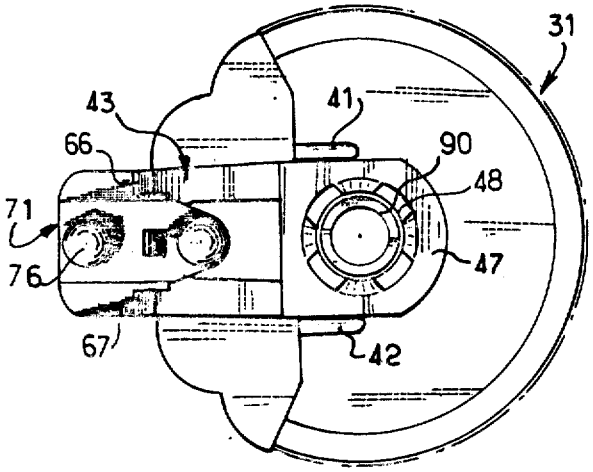
Fig. 7
Fig. 8
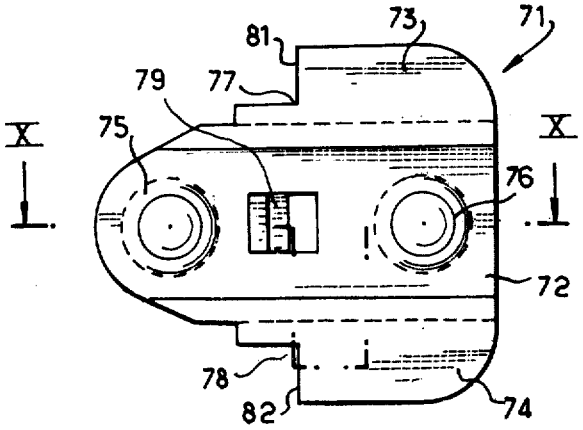
Fig. 9
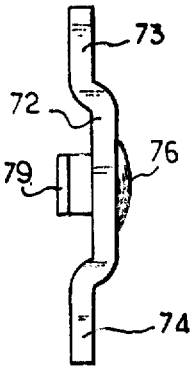
Fig. 10
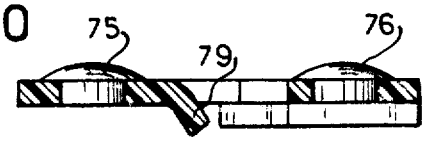

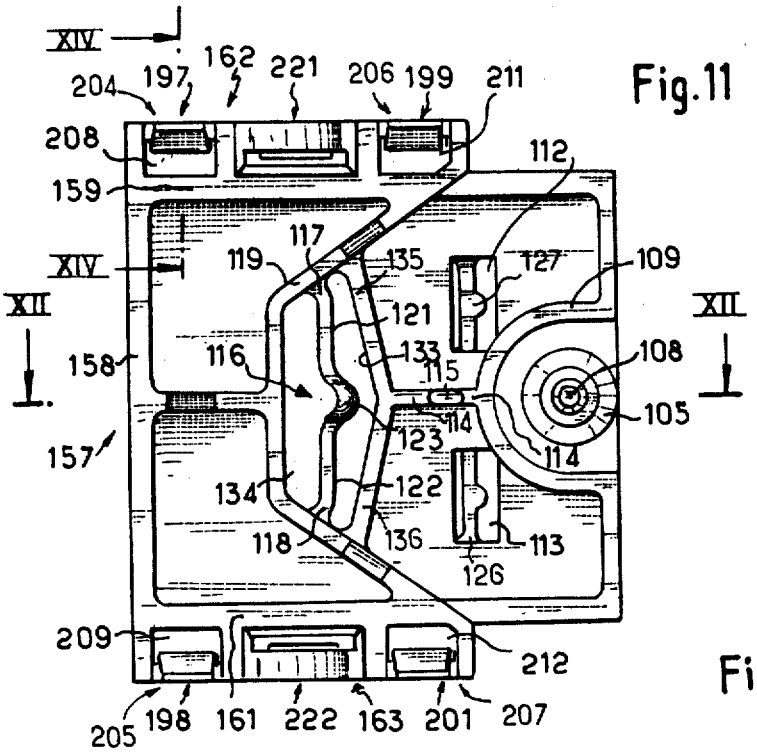
Fig.11
Fig.14
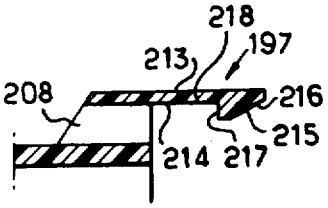
Fig.12
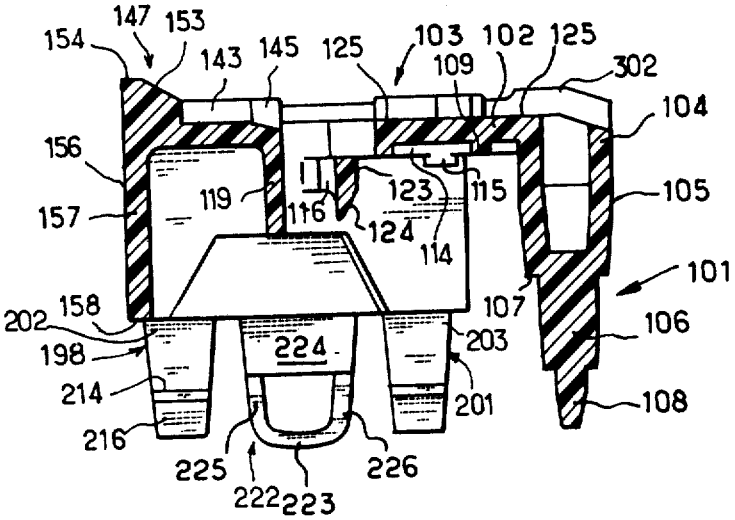

SWITCHING DEVICE, NOTABLY FOR THE CONTROL OF AN ELECTRICAL MOTOR IN AN AUTOMOTIVE VEHICLE

BACKGROUND OF THE INVENTION

1. Field of the Invention

The invention relates to a switching device, notably for the control of an electrical motor which is part of the equipment of an automotive vehicle.

Such a switching device is provided in particular for being at the disposal of a user and/or the driver of the vehicle with a view to selecting the various operating speeds of an electric motor driving the fan of a heating and/or air-conditioning installation of the vehicle.

2. Object and Summary of the Invention

The object of the invention is such a device in which the actuating member is a rotary cylindrical knob placed such as to be partly protruding relative to one face of the instrument board and which, due to its characteristics, presents notably two qualities which are apparently contradictory; the first being that of allowing an easy manipulation of the actuating member by the user and/or the driver, the actuation of said member being carried out by exercising a very small effort, the second being that of ensuring an unequivocal selection of the various operating speeds of the fan motor by an accurate positioning of said member.

While exhibiting said two qualities, the device is very reliable and withstands the most severe conditions of utilization, particularly the vibrations which are permanent in an automotive vehicle running on a road.

The present invention allows ensuring a constant and permanent pressure of the brushes of a rotating member on the conductive tracks allowing the various electrical connections which are necessary for the control of the motor.

Also with a view to providing reliability, the invention provides a mounting of the device unit in the instrument board of the vehicle, without clearance in the three dimensions (lateral, vertical and longitudinal).

The design of the unit being directed by the laws prevailing in the automobile industry, viz. the smallest cost and a mass production, its various constituents are preferably obtained by molding plastics materials.

For the same reasons, another object of the invention is to allow the easy assembly of said constituents as well as a quick insertion of the unit in the instrument board to which it is destined.

Particularly, the rotating electrical switch device with an actuating knob is characterized in that the actuating knob which carries a slider contact is slidably and rotatably mounted on a small column which is part of a cage, a plate with electrical circuits with which cooperate this slider contact being also mounted on the small column and fixedly secured in position by snap-in engagement with the walls of the cage for providing a determined contact pressure between the slider contact and the circuits.

BRIEF DESCRIPTION OF THE DRAWINGS

In the following description which is given by way of example, reference is made to the accompanying drawings wherein:

FIG. 1 is an elevation view of the knob;

FIG. 2 is a side view of the knob of FIG. 1;

FIG. 3 is a similar view to FIG. 1 but as seen from the opposite face;

FIG. 4 is a sectional view along line IV—IV of FIG. 3;

FIG. 5 is a frontal view of a resilient plaquette;

FIG. 6 is a perspective view of said plaquette;

FIG. 7 is a similar view to FIG. 1, but with the knob being provided with a resilient plaquette and with a slider contact;

FIG. 8 is a view at a larger scale of the slider contact;

FIG. 9 is a view of said slider contact, but at 90° relative to the previous Figure;

FIG. 10 is a sectional view along line X—X of FIG. 8;

FIG. 11 is a frontal view of the cage;

FIG. 12 is a sectional view along line XII--XII of FIG. 11;

FIG. 14 is a sectional view along line XIV—XIV of FIG. 11;

DESCRIPTION OF THE PREFERRED EMBODIMENTS

Figure 15:
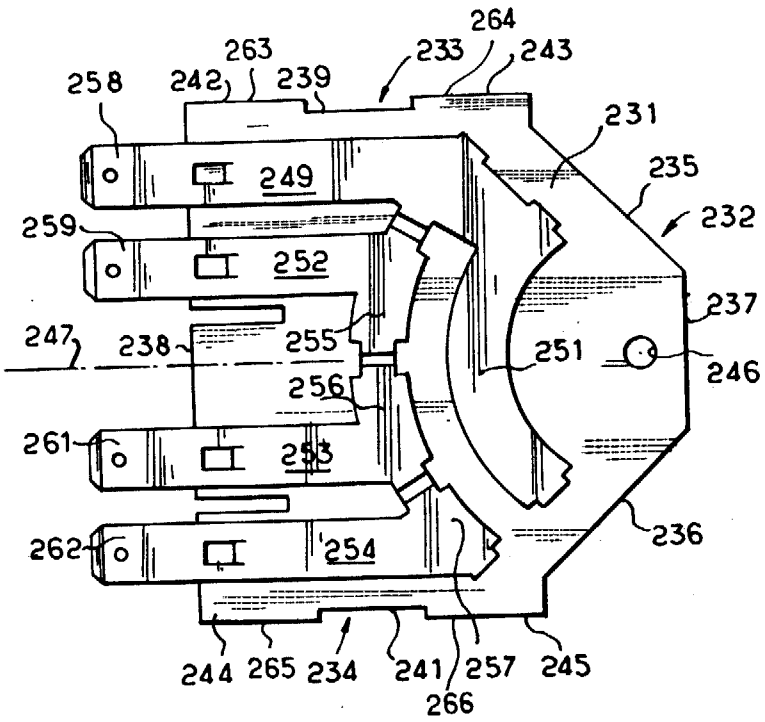
FIG. 15 is a view of a plate with electrical tracks.

The switching device according to the invention comprises an actuating member formed by a knob 31 (FIGS. 1 to 4), having the general shape of a hollow disc or flat cylinder, limited by two parallel plane flanges 32 and 33 and a cylindrical side wall or edge 34.

A portion 51 of flange 33, protruding relative to flange 32, is formed with cut-out circular arcs $\mathbf{51}_1$, $\mathbf{51}_2$, $\mathbf{51}_3$, $\mathbf{51}_4$ of smaller radius than that of the flanges, and the intersections of which define notches, four in number in the example, $\mathbf{52}_1$, $\mathbf{52}_2$, $\mathbf{52}_3$ and $\mathbf{52}_4$.

The edge 34 of the knob 31 is knurled, or in other words is formed with a succession of grooves 83 alternating with ridges 84. Advantageously, a line 85 of a colour contrasting with that of the rest of the knob, is formed transversely on the edge, viz. parallel to the rotation axis 91 of the knob.

The flange 32 and the side wall 34 are cut out, the first along an edge having a rectilinear portion 35 and two radial portions 36 and 37 connected to the perpendicular edges 38 and 39 defining the cutting of the side wall.

The flange 32 has a tubular hub 48 with an end edge 90.

A metallic plaquette 43 (FIGS. 5 and 6) which is a contact biasing means, is formed in a plane body portion 53 with an opening 54 of a slightly trapezoidal shape limiting legs 55 and 56, the body of the plaquette extending into an edge 57, substantially perpendicular to the body, its contour defining two rectangular notches 58 and 59 on either side of which are two side lugs 61 and 62, which are longer, from the folding line 63 limiting the edge 57, than the central tooth 65 having an upper edge 64. The lugs 61 and 62 end into turned-in bends 66 and 67, parallel to the body of the plaquette, but opposite to the latter relative to the edge 57.

In the opposite portion of the opening 54, the metallic plaquette 43 is formed with an aperture 44 bordered by radial tongues 45 deflected at their joint 46 connecting them to the portion 47 of the body of said plaquette slightly out of level relative to portion 53.

Said tongues 45, which exhibit a certain amount of resiliency, allow therefore an easy mounting of the plaquette 43 on the hub 48 of knob 31 (FIG. 7). Their deflection prevents the plaquette 43 from escaping from the hub 48.

In order to secure the plaquette 43 fixedly in rotation on the knob 31, the latter comprises two rectilinear bars 41 and 42 (FIG. 7), which are part of flange 32, protruding relative to the outer surface 40 of the latter and perpendicular to the rectilinear portion 35.

On the plaquette 43 is mounted a slider contact 71 (FIGS. 8 to 10), the body 72 of which, made of an electrically conducting metal, is bordered by two ears 73 and 74 and carries two contacts 75 and 76 which are "bi-metal" rivets crimped by their copper end on the slider while their silver head forms the contact surface with electrical tracks which will be described hereafter.

Two cuts 77 and 78 and a small lug 79, starting from the body 72 and formed by cutting and folding, allow an easy mounting of the slider contact 71 on the plaquette 43, the body 72 of said slider contact being flanked by the legs 61 and 62 of the plaquette 43 with which cooperates thus the ridges 81 and 82 of the ears 73 and 74.

Figure 17:
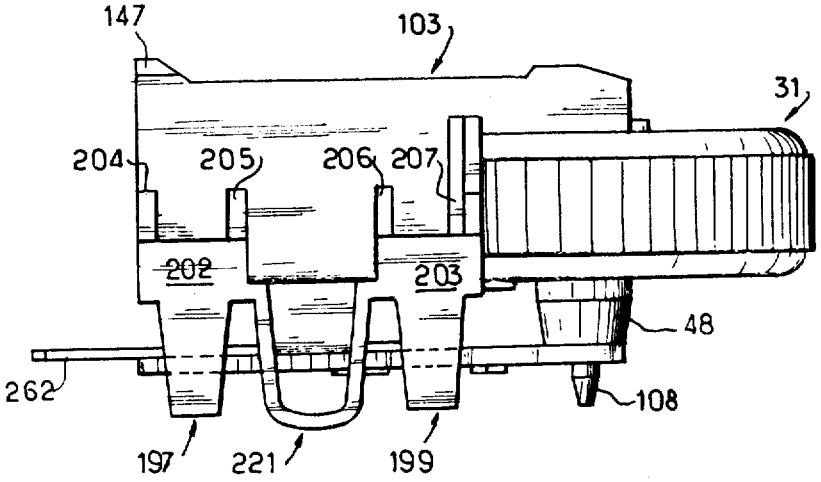
FIG. 17 is a view at 90° relative to the previous one of the assembly formed by the cage carrying the knob and the plate.

The flange 33 of the knob 31 (FIGS. 1 to 4) is formed with a central opening 96 bordered by a collar 97. It is through said opening that the unit formed by the knob 31, the plaquette 43 and the slider contact 71 is slipped onto a small column 101 (FIGS. 11 and 12) erected on the wall 102 of a cage 103 which is part of the switch casing. The small column 101 has a cylindrical base 104 extending into a frustoconical bearing portion 105 and then by a cylindrical portion 106 of smaller diameter, defining with the bearing portion 105 a shoulder 107, and ending into a tapered portion 108. When the knob 31 is completely slipped onto the small column 101, the collar 97 (FIGS. 3 and 4) which is formed on the flange 33 is housed between the base 104 and a semi-circular rib 109 formed on the wall 102 of the casing and the tapered portion 108 protrudes relative to the end edge 90 of the hub 48 (FIG. 17).

The wall 102 comprises rectangular windows 112, 113 with corners cut off 112' and 113' on either side of a central rib 114, the median portion of which is of greater height and defines thus a tooth 115.

The flange 33 of knob 31 (FIG. 3) is formed, on its outer face 86, with an annular recess slot 87 with two circular edges 88 and 89, centered on axis 91 of the knob and which is delimited at the ends by two up-turned portions 93, the edges 94 and 95 of which, parallel to the outer surface 86, being thus protruding relative to the latter.

When the knob 31 is slipped onto the small column 101, the tooth 115 moves inside the annular recess 87 and thereby completes the guiding in rotation of said knob 31 while the cooperation of said tooth 115 with the up-turned portions 94 and 95 provides in a positive way the limitation of the rotary movement of the knob 31 in one direction and the other. A small bridge 116 depends, by its ends 117 and 118, from a wall 119 having the shape of a U with diverging legs, erected on the wall 102. The central portion of the small bridge is curved towards the small column 101 and the surfaces 121 and 122 of the two halves of the small bridge turned towards said small column are connected by a semi-cylindrical surface 123, having a relatively small radius of curvature, said semi-cylindrical surface extending into a semi-conical point 124.

The knob 31 being thus mounted and guided, the edge of the flange 33 formed by the arcs 51 cooperate with the small bridge 116 and the resiliency of the latter allows a secure positioning of the knob 31 in its various operation positions, the end 123 of the small bridge cooperating with the notches $52_1$, $52_2$, $52_3$ and $52_4$.

The effort which the user has to exert for passing from one position to the other is small since all what is needed is to overcome the resiliency force of the small bridge 116.

On the other hand, on the introduction of the knob 31 in an angular position in which one of the notches 52 of the flange 33 is in register with the semi-cylindrical surface 123 of the small bridge 116, the presence of the conical point 124 ensures that the progression of the movement of the knob does not risk to deform said small bridge 116.

On the outer face 125 of the wall 102 and opposite the windows 112 and 113, said wall is formed with two ribs 126 and 127 (FIG. 13) prolongating each other and forming the two parts of a bar having the configuration of a T and the double body of which is formed with parallel ribs 128 and 129 the ends 131 and 132 of which are at right angles with the edge 133 of a window 134 formed on the bottom 102, the edge 133 being that of the legs 135 and 136 of a Y of which the rib 114 is part. The window 134 has a pentagonal shape and is limited further by two sides 137, 137 diverging from the base 138 and to which are connected two sides 139, 141 having the shape of the legs of the Y and forming the edge 133.

Substantially in the prolongation of the ribs 128, 129 (FIGS. 12 and 13) are, on the outer face 125 of the bottom 102, two further ribs 142, 143 ending towards the edge 138 into diverging portions 144, 145 so as to provide an enlarged inlet 146. The two ribs 142 and 143 are connected to each other in a block 147 the faces 148, 149 of which form the prolongation of the outer faces 151, 152 of the ribs 142, 143, the block being limited by an oblique face 153 connected to a face 154 parallel to the outer face 125 of the bottom 102, the face 155 of the block which is opposite the ribs 142, 143 being co-planar with the outer surface 156 of the wall 157 which is perpendicular to the bottom 102. The wall 157 ends into an edge 158 co-planar with the edges 159, 161 of the two other parallel walls of the cage, respectively 162, 163.

From the walls 162, 163 depend, at the back, teeth 197 and 198 (FIGS. 11 to 13) and, closer to the front part, teeth 199 and 201. Said teeth are connected to the wall from which they depend by roots 202 and 203 from which depend ears 204, 205, and 206, 207 limiting openings 208, 209; 211, 212.

The profile of a tooth, for example tooth 197, is limited by two substantially parallel faces, one 213 being outside or forming the back, and the other 214 (FIG. 14), and ends into a hooked end or beak 215 having an oblique face 216 providing a shoulder 217 with the body 218 of the tooth.

Each of the walls 162 and 163 is prolongated, between the teeth 197, 199 and 198, 201, by a hoop or finger, respectively 221 and 222, each hoop being shaped as a handle and having a curved bend 223 connected to the body 224 by two legs 225 and 226.

Figure 13:
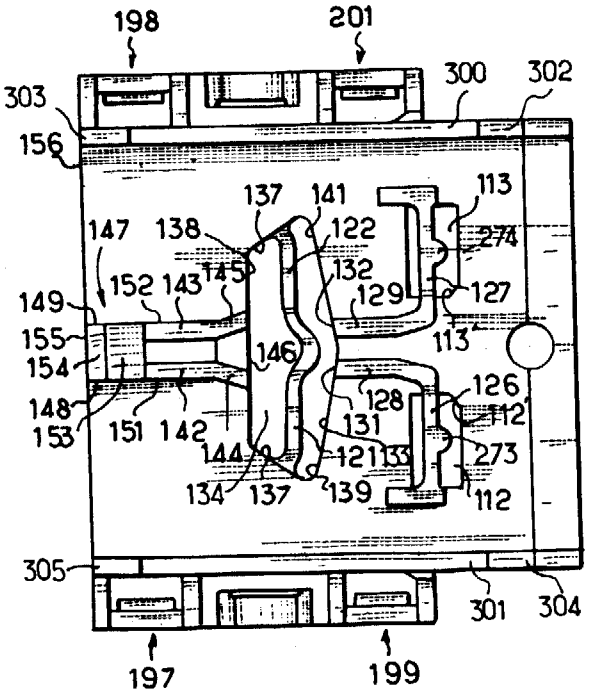
FIG. 13 is a view of the cage, as seen from its opposite face.

On the outer side of the wall 202 are protruding ribs 300 and 301 (FIG. 13) comprising each two raised surfaces, respectively 302, 303 and 304, 305 (FIGS. 12 and 13).

The electrical circuits are carried on the face 231 (FIGS. 15 and 16) of a plate 232 made of an insulating material, the profile of which recalls that of a house and a roof, with two parallel edges 233 and 234 connected by two oblique sides 235 and 236 and an intermediate side 237 perpendicular to the sides 233 and 234, the base 238 of the plate being parallel to the side 237. The sides 233 and 234 are formed with a median notch, respectively 239 and 241, distinguishing small tabs, respectively 242, 243 and 244, 245. The plate 232 is formed with a perforation 246 adjacent the side 237 and on the median line 147 parallel to sides 233 and 234.

In the example shown, the face 231 of the plate receives a first electrical circuit 249 comprising a track in the shape of an arc of a circle 251 and three other electrical circuits 252, 253, 254 comprising portions of circular tracks, respectively 255, 256 and 257. Said circuits protrude relative to the edge 238 of the plate by forming fingers, respectively 258, 259, 261, 262. The fixation of the various circuits on the plate is provided with the assistance of turned portions 263 which are visible on FIG. 16.

Figure 16:
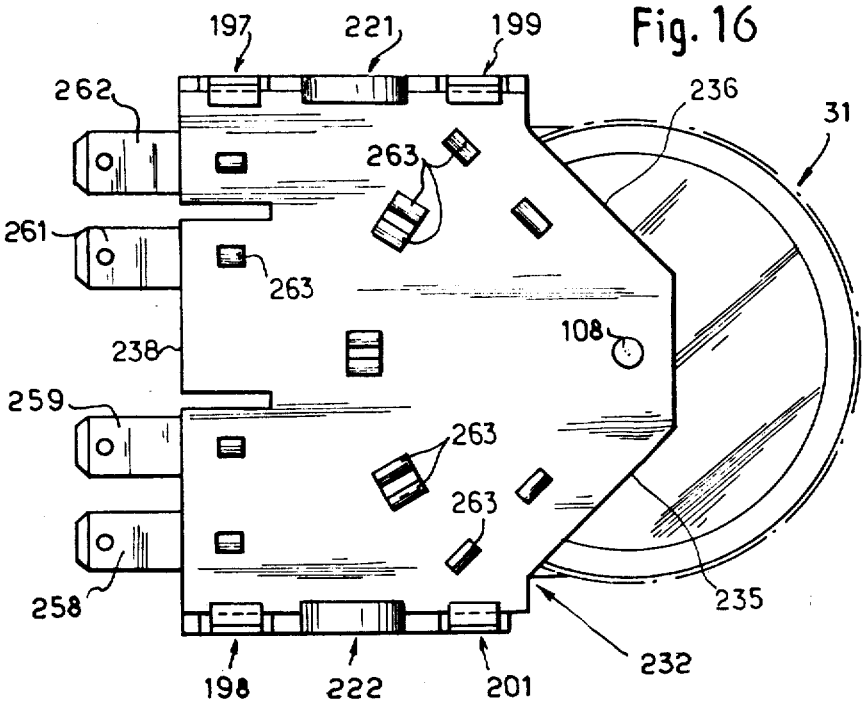
FIG. 16 is a view of such a plate, but as seen from the opposite face and after being mounted.

On the unit formed by the knob 31, the plaquette 43 and the slider contact 71 mounted, as described hereabove, on the small column 101 of cage 102, one places the electrical circuits plate 232 by introducing the appendix 108 of said small column 101 in the hole 246 (FIGS. 16 and 17). During this introduction operation, the edges 263 to 266 of the small tabs 242 to 245 of plate 232 come in engagement with the oblique faces 215 of the teeth 197, 198, 199, 201, and due to the thinness of the joints of said teeth with the wall, respectively 162 and 163, said teeth slightly deviate till the small tabs 242 to 245 escape the beaks of the teeth and come to sit under the shoulders 217 of the latter, the teeth in register coming then close to each other under the effect of the resiliency of their joints.

The contact relationship between the studs or sliding contacts 75 and 76 of slider contact 71 and the electrical circuits 249 on the one hand, 255, 256 and 257 on the other hand, carried by the plate 232, is carried out permanently and under the appropriate pressure due on the one hand to the plaquette 43 which, because of its resiliency proper, reacts on the slider contact 71, and on the other hand to the counter-bracing provided by the shoulders 217 of the teeth 197, 198, 199, 201, at the edges 233, 234 of the plate 232.

Thus is provided an easy and quick mounting, and therefore at a lesser cost, of a switch, while providing in the course of time and in spite of vibrations to which the vehicle is subjected a permanent contact between the slider and the electrical tracks.

In particular, the relationship conditions between the slider contact and the electrical tracks being determined and constant, the pressure can be sufficiently low so that the knob 31 may be acted upon easily under the action of one finger on the knurling of its side surface and without an outer protrusion being necessary and necessitating the exertion of a notable effort.

Figure 18:
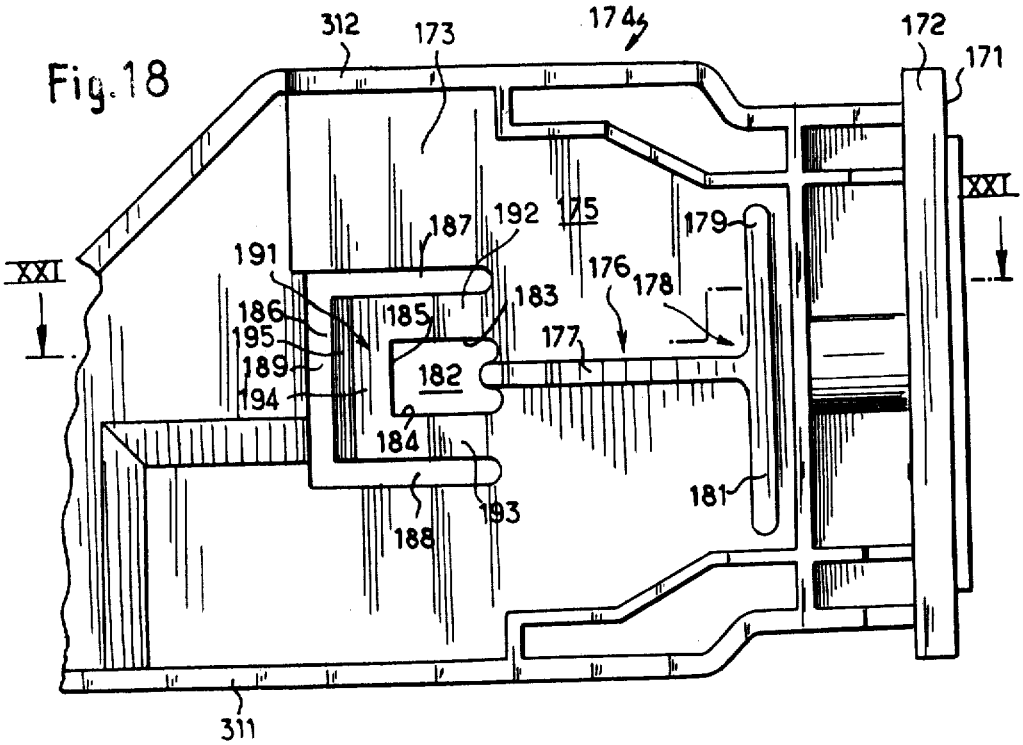
FIG. 18 is a frontal view of the wall of the casing with which the cage is adapted to cooperate.
Figure 19:
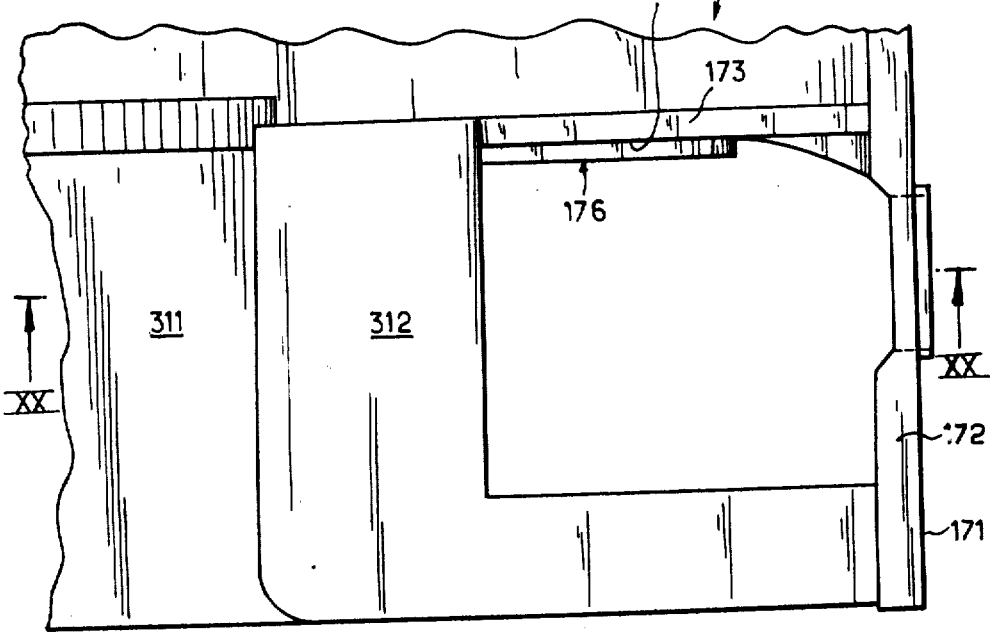
FIG. 19 is a view at 90° relative to the previous one of the portion of the casing.
Figure 20:
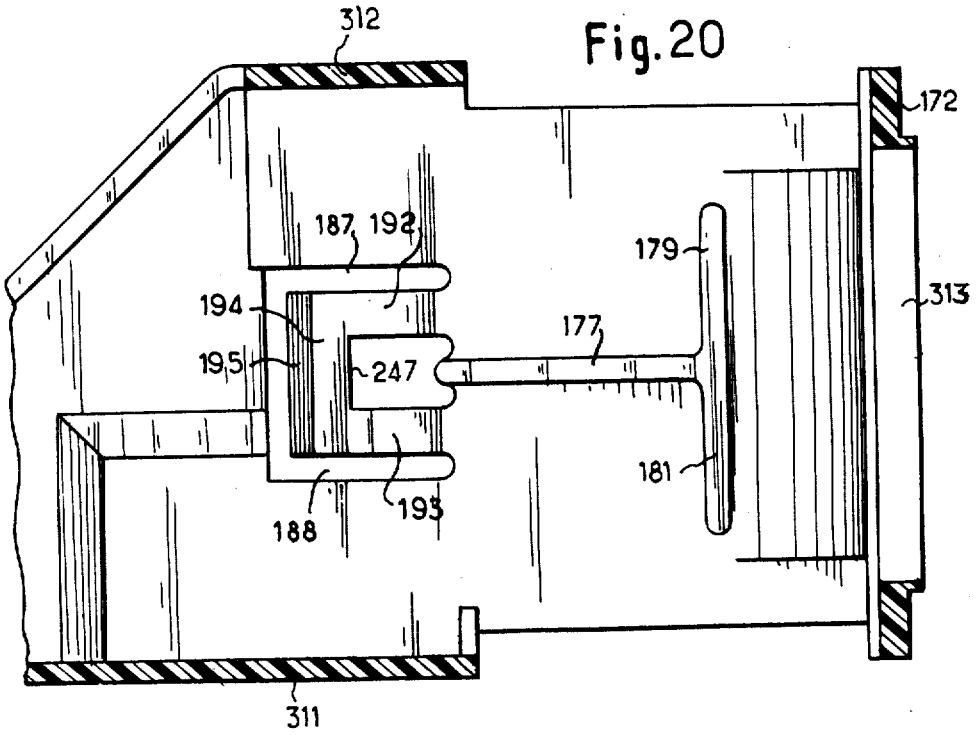
FIG. 20 is a sectional view along line XX—XX of FIG. 19.
Figure 21:
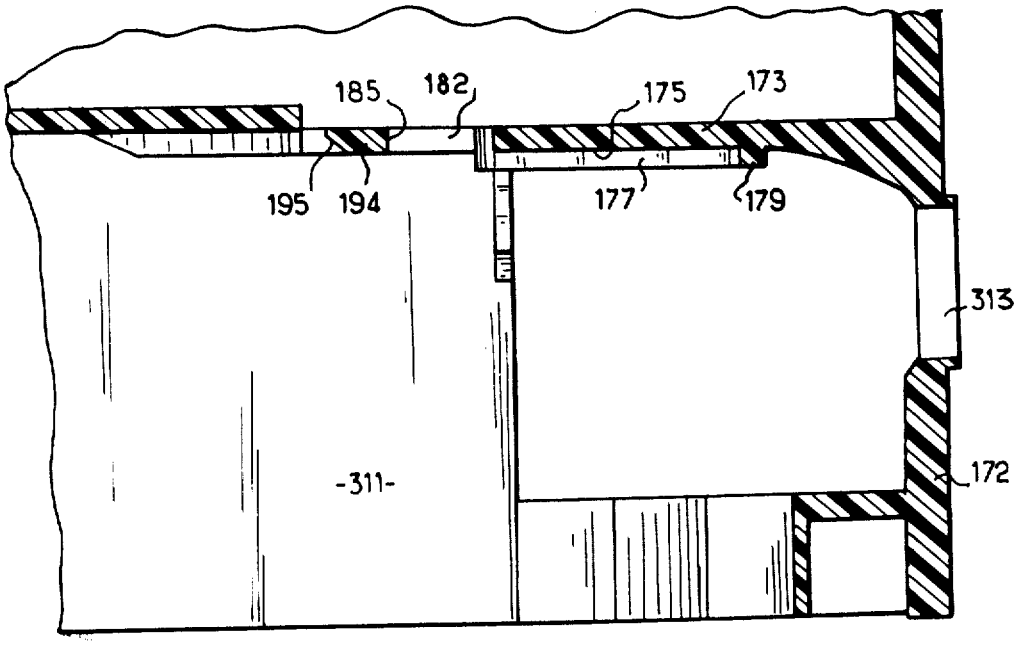
FIG. 21 is a sectional view along line XXI—XXI of FIG. 18.

The outer face 125 of the bottom 102 of the cage is organized so as to be able to cooperate, by being introduced on the rear, viz. opposite the outer face 171 (FIG. 18) of the instrument board 172 of a motor vehicle, with a wall 173 of the casing or support 174 of which the instrument board 172 is part. The inner face 175 of the wall 173 is formed, close to its front end, viz. close to the instrument board, with a protrusion 176 in the shape of a T with a rib 177 perpendicular to the outer face 171 and a bar 172 with two legs 179 and 181. The rib 177 ends at the overhang of an opening 182 of substantially rectangular contour, the sides 183 and 184 of which are parallel to the rib 177 and one side 185 perpendicular to said rib. A U-shaped opening 186 with two legs 187 and 188 parallel to rib 177 and a bottom 189 limit, with the opening 182, a U-shaped tongue 191 with legs 192 and 193 and a bottom 194, the outer edge 195 of the bottom 194 being bevelled.

The unit formed by the knob 31, the metallic plaquette 33, the slider contact 71 and the electrical circuit plate 232, assembled in the cage 103, as described hereabove, is introduced by the rear in the cavity provided thereto in the casing or support which is part of the instrument board. The backs of the teeth 197, 198 and 199, 201 guide the movement by cooperating with the faces in register of the casing walls 311 and 312 and, in the perpendicular direction, by cooperation of raised surfaces 302, 303 and 304, 305 with the surface 175 of wall 173 on the one hand, and the hoops 221 with a wall of casing 174 opposite wall 173. The opening provided by the ribs 128 and 129 (FIG. 13) with diverging ends reaches the end of the rib 177 which is protruding relative to wall 173; and it is after, between the ribs 142 and 143, also with diverging ends 144, 145, that the end of the rib 177 which is rigidly connected to wall 173 is engaged.

The cooperation of the rib 177 with the slots provided in the cage 103 by the ribs 128, 129 on the one hand, and 142, 143 on the other hand, allows immobilizing without any clearance in the vertical direction the switch assembly in the instrument board.

During the whole of this movement, the hoops 221 and 222 depending from the walls 162 and 163 of cage 103 are in a sliding relationship against wall elements of the casing or support and thereby provide a mounting without clearance in the lateral direction due on the one hand to the resilience of the hoops 221 and 222 and on the other hand to the bearing on the opposite face of the portions 302, 303 and 304, 305 of ribs 300 and 301.

At the end of the movement, the small bars 126 and 127 carrying rounded protrusions 273 and 274 come in engagement with the bars 179 and 181 which are rigidly connected to the wall 173 and are resiliently deformed, while the oblique face 153 of the small block 147 which the case 103 comprises urges the U-shaped leg 194 away, said leg bending about its joint 192, 193.

In the final position, the U-shaped leg 194 resumes its initial position and the inner edge 185 of its bottom comes in engagement with the frontal face 155 of block 147, the cage being thus maintained in a positive way and without clearance in the longitudinal direction due to the resiliency of the ribs 126 and 127. The switch assembly is thus maintained as regards to movements in all directions in spite of the vibrations to which the vehicle is subjected due to the running of the engine and also the circulation on the road.

In its final position, the knob 31 is slightly protruding relative to the anterior face 171 of the instrument board through a rectangular window 313 formed in said face.

The device is easily adaptable to various configurations of the casings provided for equipping the instrument board of a vehicle.

What is claimed is:

1. An electrical switching device comprising:

an actuating rotary knob formed as a hollow disc and having parallelly disposed first and second flanges and a knurled side edge interposed therebetween, said first flange having a circular collar projecting outwardly from a surface thereof and bordering an opening formed centrally in said first flange and a plurality of notches formed about the periphery thereof and provided by the intersections of convex circular arcs;

an electrically conductive slider contact attached to said rotary knob;

a cage having a bottom portion and walls perpendicularly joined to the bottom portion; said cage bottom portion having a column extending perpendicularly from an inner surface thereof and on which said rotary knob is slidably and rotatably mounted, a circular rib protruding from the inner surface thereof which cooperates with said circular collar of said first flange, and a bridge extending from the inner surface of said cage bottom portion, said bridge including a protrusion and resilient end members joined to said protrusion at a first end of each and joined to said cage bottom portion at a second end of each thereby resiliently supporting said bridge above the inner surface of said cage bottom portion, said protrusion cooperating with said notches formed in the periphery of said first flange; and a fixed plate to which is attached an electrical circuit which cooperates and is in contact with said slider contact, said fixed circuit plate being mounted on said column so that said rotary knob is interposed between said fixed circuit plate and said cage bottom portion, said fixed circuit plate being positioned in relation to said rotary knob to provide a determined contact pressure between said slider contact and said electrical circuit, said fixed circuit plate being immobilized in position by a snap-in engagement with said cage walls.

2. An electrical switching device comprising:

an actuating rotary knob formed as a hollow disc and having parallelly disposed first and second flanges and a knurled side edge interposed therebetween, said first flange having a circular collar projecting outwardly from a surface thereof and bordering an opening formed centrally in said first flange and a plurality of notches formed about the periphery thereof and provided by the intersections of convex circular arcs;

an electrically conductive slider contact attached to said rotary knob;

a cage having a bottom portion and walls perpendicularly joined to the bottom portion; said cage bottom portion having a column extending perpendicularly from an inner surface thereof and on which said rotary knob is slidably and rotatably mounted, a circular rib protruding from the inner surface thereof which cooperates with said circular collar of said first flange, and a bridge extending from the inner surface of said cage bottom portion, said bridge including a protrusion and resilient end members joined to said protrusion at a first end of each and joined to said cage bottom portion at a second end of each thereby resiliently supporting said bridge above the inner surface of said cage bottom portion, said protrusion being semi-cylindrical and extending into a conical point, said protrusion cooperating with said notches formed in the periphery of said first flange; and a fixed plate to which is attached an electrical circuit which cooperates and is in contact with said slider contact, said fixed circuit plate being mounted on said column so that said rotary knob is interposed between said fixed circuit plate and said cage bottom portion, said fixed circuit plate being positioned in relation to said rotary knob to provide a determined contact pressure between said slider contact and said electrical circuit, said fixed circuit plate being immobilized in position by a snap-in engagement with said cage walls.

3. An electrical switching device comprising:

an actuating rotary knob formed as a hollow disc and having a parallelly disposed first and second flanges and a knurled side edge interposed therebetween, said first flange having a circular collar projecting outwardly from a surface thereof and bordering an opening formed centrally in said first flange, a plurality of notches formed about the periphery thereof and provided by the intersections of convex circular arcs, a recess formed in the thickness thereof and shaped as a circular arc, and end edges projecting outwardly from the surface of said first flange and positioned at each circumferential end of said recess;

an electrically conductive slider contact attached to said rotary knob;

a cage having a bottom portion and walls perpendicularly joined to the bottom portion; said cage bottom portion having a column extending perpendicularly from an inner surface thereof and on which said rotary knob is slidably and rotatably mounted, a circular rib protruding from the inner surface thereof which cooperates with said circular collar of said first flange, an abutment projecting outwardly from the inner surface of said cage bottom portion which cooperates with said end edges of said first flange to limit the rotational travel of said rotary knob, and a bridge extending from the inner surface of said cage bottom portion, said bridge including a protrusion and resilient end members joined to said protrusion at a first end of each and joined to said cage bottom portion at a second end of each thereby resiliently supporting said bridge above the inner surface of said cage bottom portion, said protrusion cooperating with said notches formed in the periphery of said first flange; and a fixed plate to which is attached an electrical circuit which cooperates and is in contact with said slider contact, said fixed circuit plate being mounted on said column so that said rotary knob is interposed between said fixed circuit plate and said cage bottom portion, said fixed circuit plate being positioned in relation to said rotary knob to provide a determined contact pressure between said slider contact and said electrical circuit, said fixed circuit plate being immobilized in position by a snap-in engagement with said cage walls.

4. An electrical switching device as defined in claim 1 wherein said actuating rotary knob further comprises a resilient plaquette mounted thereon, said slider contact being mounted on said resilient plaquette.

5. An electrical switching device as defined in claim 4 wherein said slider contact is removably mounted on said resilient plaquette.

6. An electrical switching device as defined in claim 4 wherein said second flange of said rotary knob includes a tubular hub projecting outwardly from the surface of said second flange and through which extends said column of said cage bottom portion, and wherein said resilient plaquette has formed therein an opening dimensioned to receive said tubular hub and at least one locking tongue bordering said plaquette opening and radially extending partially thereinto.

7. An electrical switching device as defined in claim 1 wherein at least one of said walls of said cage include at least one tooth resiliently joined thereto, said tooth having a hooked end for engagement with and immobilization of said fixed circuit plate.

8. An electrical switching device as defined in claim 1 which further comprises a walled casing which houses said cage and from which depends an instrument board of a vehicle.

9. An electrical switching device as defined in claim 8 wherein said casing comprises and said cage further comrpises means for slidably guiding and locking said cage into said casing, said guiding and locking means being formed on an outer surface of said cage bottom portion and on a cooperating inner wall of said casing, said guiding and locking means including rib and slot means having at least one tooth resiliently urged and a corresponding opening for locking said cage relative to said cooperating inner wall of said casing.

10. An electrical switching device as defined in claim 9 wherein said rib and slot means further comprises a slot formed in the outer surface of said cage bottom portion and two parallel ribs projecting outwardly from the outer surface of said cage bottom portion on opposite sides of said slot and disposed parallel to the direction in which said cage is slidably guided into said casing, each of said parallel ribs extending at one end thereof into a thin small bar perpendicularly disposed to its respective parallel rib, said bar having end portions and a central portion interposed between said end portions, said central portion being thicker than said end portions.

11. An electrical switching device as defined in claim 10 wherein said cooperating inner wall of said casing has a protruding transverse rib disposed to be cooperative with and receivable between said parallel ribs of said cage bottom portion.

12. An electrical switching device as defined in claim 9 wherein said cooperating inner wall of said casing has two cutouts formed therein and a U-shaped leg defined by said cutouts and attached to said cooperating inner wall by resilient joints and wherein said cage bottom portion further comprises a block which cooperates with said U-shaped leg, said block being shaped as a tooth and projecting outwardly from the outer surface of said cage bottom portion.

13. An electrical switching device as defined in claim 12 wherein said block is positioned at an end of said slot formed in said cage bottom portion.

14. An electrical switching device as defined in claim 9 wherein a wall of said cage has formed on an edge thereof at least one finger to cooperate resiliently with an opposite wall of said casing.

15. An electrical switching device as defined in claims 14 wherein said finger has the shape of a handle.

16. An electrical switching device as defined in claim 14 or 15 wherein said finger is flanked by teeth.

* * * * *